US007495681B2

(12) United States Patent
Liu et al.

(10) Patent No.: US 7,495,681 B2
(45) Date of Patent: Feb. 24, 2009

(54) RESOLUTION DETECTION METHOD FOR AN ELECTRONIC DISPLAY DEVICE

(75) Inventors: Yun-Wen Liu, Pingjhen (TW); Min-Jye Chen, Miaoli (TW)

(73) Assignee: Qisda Corporation, Taoyuan County (TW)

( * ) Notice: Subject to any disclaimer, the term of this patent is extended or adjusted under 35 U.S.C. 154(b) by 709 days.

(21) Appl. No.: 11/122,449

(22) Filed: May 5, 2005

(65) Prior Publication Data

US 2005/0259094 A1 Nov. 24, 2005

(30) Foreign Application Priority Data

May 19, 2004 (TW) ..... 93114074 A

(51) Int. Cl.
*G09G 5/02* (2006.01)

(52) U.S. Cl. ..... 345/698; 345/76; 345/82; 345/84; 345/85; 345/86; 345/87; 345/204; 345/699

(58) Field of Classification Search ..... 345/55, 345/60, 73, 74.1, 76, 82, 84, 85, 86, 87, 211, 345/212, 213, 698, 699, 204
See application file for complete search history.

(56) References Cited

U.S. PATENT DOCUMENTS

| | | | | |
|---|---|---|---|---|
| 6,236,388 | B1 * | 5/2001 | Iida et al. | 345/698 |
| 6,295,048 | B1 * | 9/2001 | Ward et al. | 715/785 |
| 6,734,846 | B1 * | 5/2004 | Yang et al. | 345/213 |
| 6,894,706 | B1 * | 5/2005 | Ward et al. | 345/660 |
| 2005/0285883 | A1 * | 12/2005 | Chen | 345/698 |
| 2007/0030395 | A1 * | 2/2007 | Lee et al. | 348/565 |

* cited by examiner

*Primary Examiner*—My-Chau T Tran

(57) ABSTRACT

A resolution detection method for an electronic display device. The method first receives a line rate, a frame rate, and a horizontal total of an electronic display device to calculate candidate resolutions. A horizontal display of the electronic display device is then received. Next, a horizontal blank is calculated according to the line rate and the horizontal display. An adjustment method for application to the electronic display device is determined according to the horizontal blank. Finally, an optimum resolution is selected from the candidate resolutions according to the determined adjustment method.

24 Claims, 4 Drawing Sheets

RESOLUTION DETECTION METHOD FOR AN ELECTRONIC DISPLAY DEVICE

BACKGROUND

The invention relates to resolution detection, and in particular to a method of detecting an optimum resolution for an electronic display device after resolution adjustment.

An electronic display device connected to a computer host may not be frequently replaced. Thus, the resolution does not generally differ. Therefore, the display card of a computer host may be designed to support only one resolution. For example, if the resolution of an electronic display device of a computer host is 1600:1200 (4:3), the display card of the computer host can be designed to support resolution of 1600:1200 only.

With the progress of computer related products, however, a single computer host may be connected to various or several electronic display devices with different resolutions, such as 16:9 or 16:10. Therefore, the display card of a computer host must be designed to support electronic display devices with different resolution.

One currently available method of providing multiple resolutions is to simulate various resolutions using the display card. For example, if an electronic display of a computer host has a resolution of 4:3, the display card of the computer host supports a resolution of 4:3. When the electronic display device is replaced, the resolution changes accordingly. If the new electronic display has a resolution of 16:9, the display card may simulate the new resolution 16:9 using the original resolution 4:3. One drawback presented by this solution, however, is that although the display card has already simulated the new resolution, the related data cannot be acquired by the electronic display device. Therefore, the electronic display device displays frames according to the original resolution, causing display distortion.

FIG. 1 is a flowchart of a conventional method for detecting resolution of an electronic display device. When an electronic display device is changed, the display card detects a new frequency and simulates a resolution accordingly (step S10). The electronic display device receives a line rate, a frame rate, and a horizontal total (step S12). The electronic display device then determines a resolution according the received parameters (step S14).

As mentioned above, the electronic display device only detects the line rate, the frame rate, and the horizontal total. The simulated resolution adjusted by the display card cannot be acquired by the electronic display device according to these parameters. Thus, the display distortion problem cannot be resolved.

Thus, a method of determining an optimum resolution according to the simulated and adjusted parameters produced by the display card is desirable.

SUMMARY

Embodiments of the invention provide a method for overcoming display distortion problems. In one embodiment, the invention provides a method for detecting parameters produced by the display card after resolution adjustment and determining an optimum resolution accordingly. The method can be applied to different electronic display devices. The method first receives a line rate, a frame rate, and a horizontal total of an electronic display device to calculate candidate resolutions. The method further receives a horizontal display of the electronic display device. A horizontal blank is then calculated according to the line rate and the horizontal display. Next, the method determines an adjustment method for application to the electronic display device according to the horizontal blank. Finally, an optimum resolution is selected from the candidate resolutions according to the determined adjustment method.

BRIEF DESCRIPTION OF THE DRAWINGS

The invention can be more fully understood by reading the subsequent detailed description and examples with references made to the accompanying drawings, wherein.

DESCRIPTION

Figure 1:
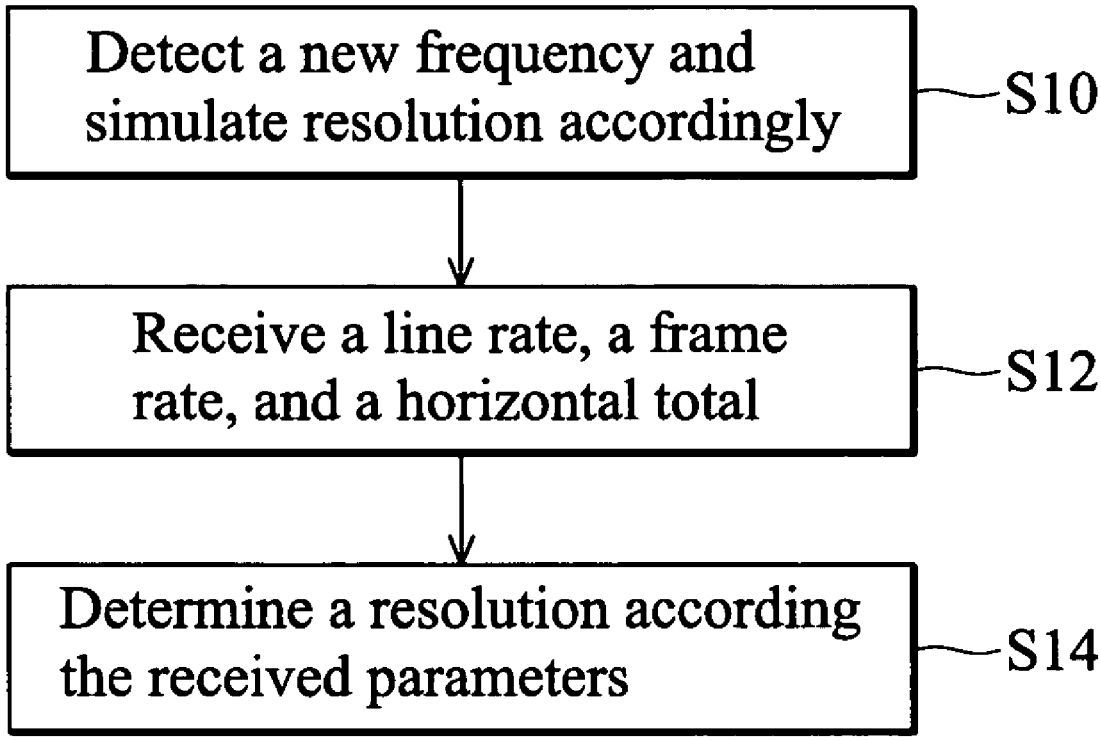
FIG. 1 (RELATED ART)
FIG. 1 is a flowchart of a conventional method for detecting the resolution of an electronic display device.
Figure 2:
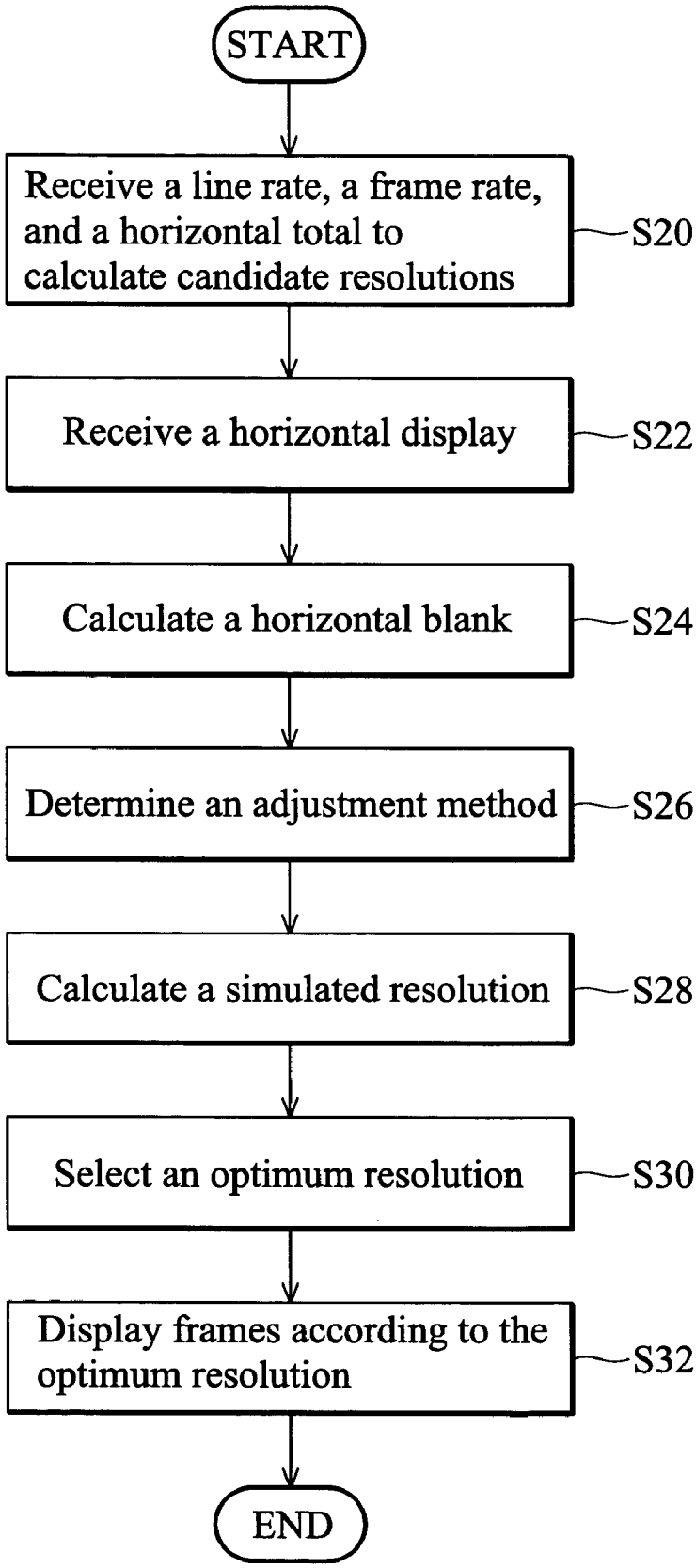
FIG. 2 is a flowchart of a method for detecting the resolution of an electronic display device according to an embodiment of the invention.

FIG. 2 is a flowchart of a method for detecting the resolution of an electronic display device according to an embodiment of the invention. In this embodiment, a line rate, a frame rate, and a horizontal total of an electronic display device are first received to calculate candidate resolutions (step S20). Next, a horizontal display of the electronic display device is received (step S22). The line rate, the frame rate, the horizontal total, and the horizontal display are produced by a display card.

A horizontal blank is then calculated according to the line rate and the horizontal display (step S24). The horizontal blank is the difference between the line rate and the horizontal display.

Subsequently, an adjustment method for application to the electronic display device is determined according to the horizontal blank (step S26). The adjustment method for application to the electronic display device may be accomplished by increasing the horizontal display or decreasing the horizontal total.

A simulated resolution is then calculated (step S28). The simulated resolution is the ratio of the horizontal total to the horizontal display. Finally, an optimum resolution is selected from the candidate resolutions according to the simulated resolution (step S30). Therefore, frames can be displayed on the electronic display device according to the optimum resolution (step S32).

Figure 3:
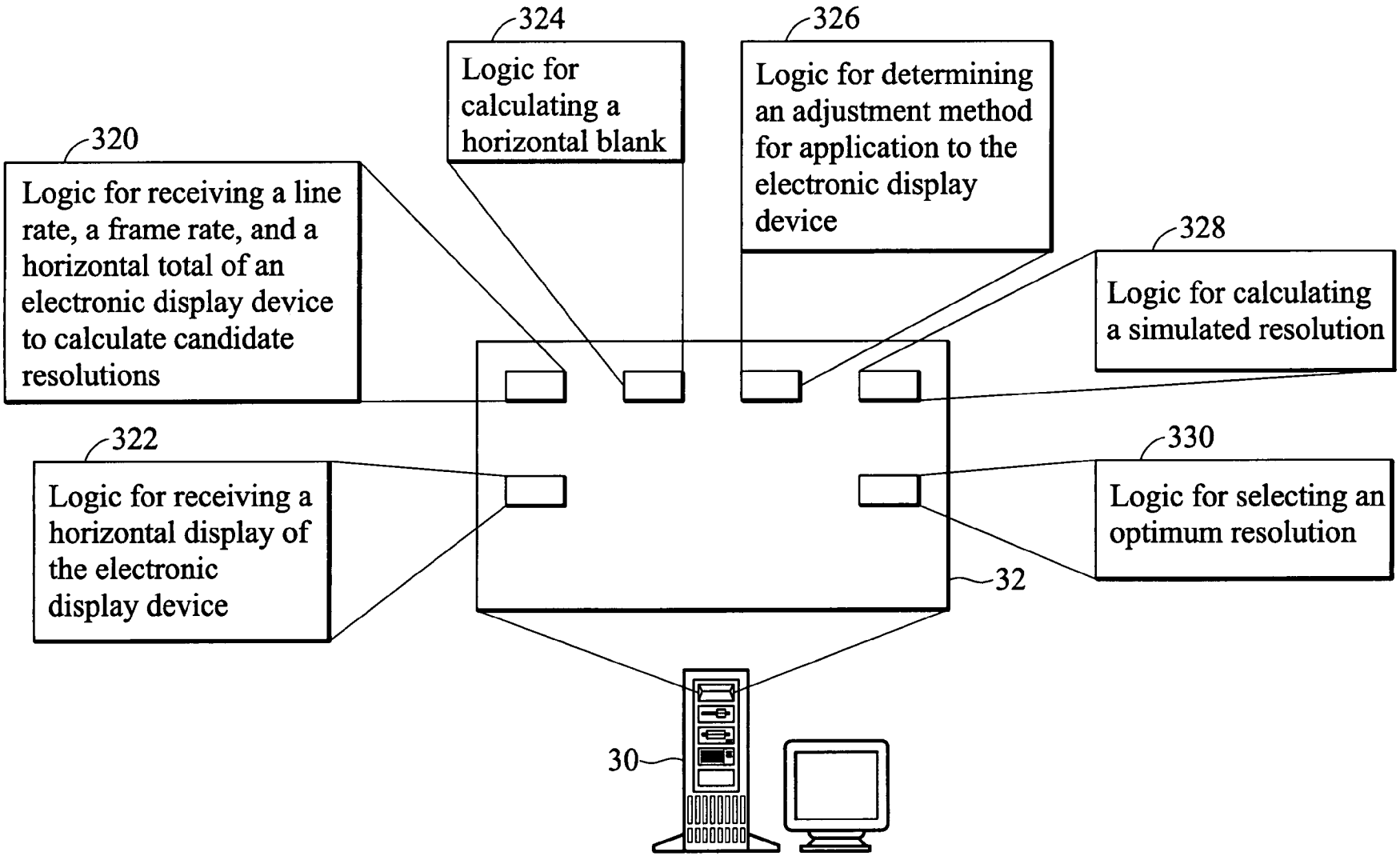
FIG. 3 is a diagram of a machine-readable storage medium storing a computer program detecting resolution for an electronic display device according to an embodiment of the invention.

The previously described method can be implemented as a computer program. FIG. 3 is a diagram of a machine-readable storage medium storing a computer program for detecting resolution of an electronic display device according to an embodiment of the invention. The computer program 32 comprises logic for receiving a line rate, a frame rate, and a horizontal total of an electronic display device to calculate candidate resolutions 320, receiving a horizontal display of the electronic display device 322, calculating a horizontal blank 324, determining an adjustment method for application to the electronic display device 326, calculating a simulated resolution 328, and selecting an optimum resolution 330.

Figure 4:
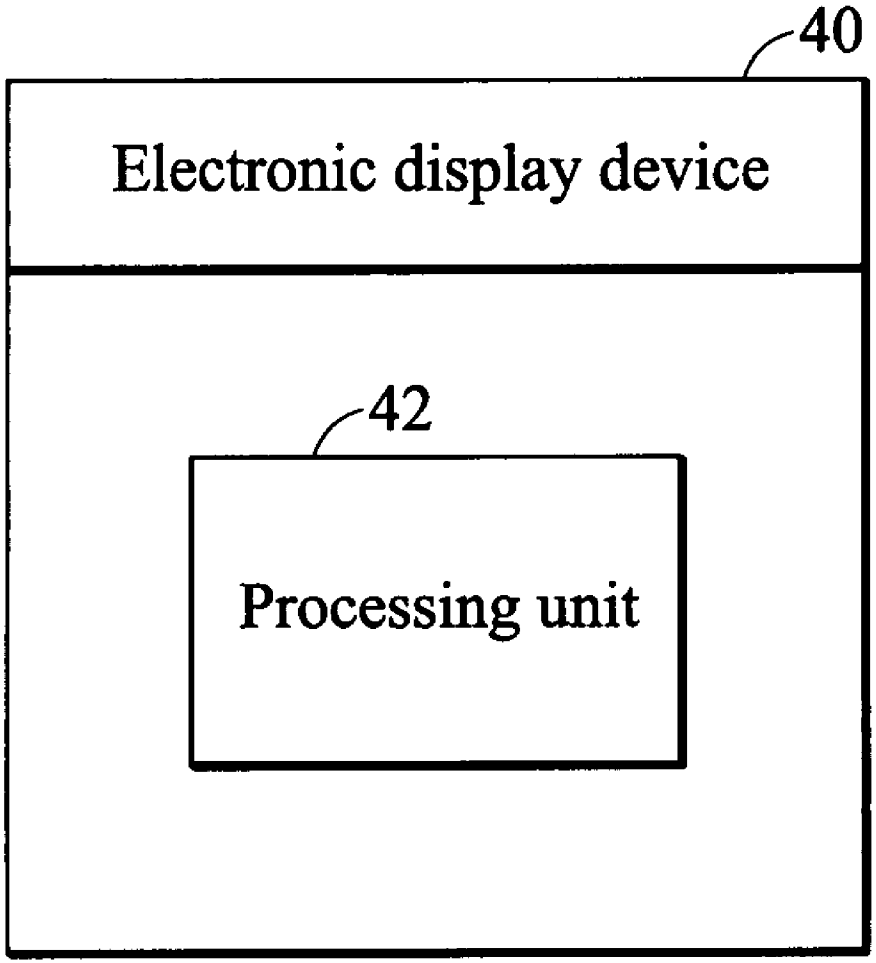
FIG. 4 is a diagram of an electronic display device according to an embodiment of the invention.

FIG. 4 is a diagram of an electronic display device according to an embodiment of the invention. In this embodiment, an electronic display device 40 comprises a processing unit 42. The processing unit 42 receives a line rate, a frame rate, and a horizontal total of the electronic display device 40 to calculate candidate resolutions. The processing unit 42 then receives a horizontal display of the electronic display device and calculates a horizontal blank according to the line rate and the horizontal display. The line rate, the frame rate, the horizontal total, and the horizontal display are produced by a display card. The horizontal blank is the difference between the line rate and the horizontal display.

The processing unit 42 further determines an adjustment method for application to the electronic display device according to the horizontal blank. The adjustment method for application to the electronic display device may be accomplished by increasing the horizontal display or decreasing the horizontal total. The processing unit 42 selects an optimum resolution from the candidate resolutions according to the determined adjustment method.

The adjustment method for application to the electronic display device comprises a step of calculating a simulated resolution. The simulated resolution is the ratio of the horizontal total to the horizontal display. Thus, the optimum resolution can be selected according to the simulated resolution.

Frames can be displayed on the electronic display device according to the selected optimum resolution. In actual implementation, the processing unit 42 may be implemented in a chip.

In one example, the resolution of an electronic display device is 1600:1200. The electronic display device is then replaced by an electronic display device with a resolution of 1920:1200. The line rate is usually invariable, such as 2160. The line rate, frame rate, and horizontal total are first received for calculating candidate resolutions, that is, 1600:1200 and 1920:1200. The horizontal display is then received, that is 1600.

Next, the line rate is subtracted by the horizontal display to obtain a horizontal blank, that is 2160−1600=560. If the display card simulates the new resolution, the horizontal blank is 2160−1920=240. Thus, an adjustment method can be determined according to the horizontal blank. In this example, because 240<560, the display card increases the horizontal display to simulate the changed resolution.

The ratio of the horizontal blank to the horizontal display is calculated to obtain a simulated resolution, that is 240/1920=0.125. An optimum resolution is then selected from the candidate solutions according to the simulated resolution. The optimum resolution is 1920:1200. Frames can be displayed on the electronic display device according to the selected optimum resolution to avoid display distortion.

Thus, embodiments of the present invention provide a method to determine an optimum resolution according to the parameters produced by a display card when the electronic display device has changed, avoiding display distortion problems.

Methods and systems of the present invention, or certain aspects or portions of embodiments thereof, may take the form of program code (i.e., instructions) embodied in media, such as floppy diskettes, CD-ROMS, hard drives, firmware, or any other machine-readable storage media, wherein, when the program code is loaded into and executed by a machine, such as a computer, the machine becomes an apparatus for practicing embodiments of the invention. The methods and apparatus of the present invention may also be embodied in the form of program code transmitted over some transmission media, such as by electrical wiring or cabling, through fiber optics, or via any other forms of transmission, wherein, when the program code is received and loaded into and executed by a machine, such as a computer, the machine becomes an apparatus for practicing embodiments of the invention. When implemented on a general-purpose processor, the program code combines with the processor to provide a unique apparatus that operates analogously to specific logic circuits.

While the invention has been described by way of example and in term of a preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of detecting electronic display device resolution, comprising:

receiving a line rate, a frame rate, and a horizontal total of an electronic display device to calculate at least one candidate resolution;

receiving a horizontal display of the electronic display device;

calculating a horizontal blank according to the line rate and the horizontal display;

determining an adjustment method for application to the electronic display device according to the horizontal blank; and selecting an optimum resolution from the candidate resolutions according to the determined adjustment method, wherein the adjustment method for application to the electronic display device further calculates a simulated resolution.

2. The method of detecting electronic display device resolution as claimed in claim 1, further displaying a frame on the electronic display device according to the optimum resolution.

3. The method of detecting electronic display device resolution as claimed in claim 1, wherein the horizontal blank is the difference between the line rate and the horizontal display.

4. The method of detecting electronic display device resolution as claimed in claim 1, wherein the adjustment method for application to the electronic display device is accomplished by increasing the horizontal display.

5. The method of detecting electronic display device resolution as claimed in claim 1, wherein the adjustment method for application to the electronic display device is accomplished by decreasing the horizontal total.

6. The method of detecting electronic display device resolution as claimed in claim 1, wherein the simulated resolution is the ratio of the horizontal total to the horizontal display.

7. The method of detecting electronic display device resolution as claimed in claim 1, wherein the optimum resolution is selected from the candidate resolutions according to the simulated resolution.

8. The method of detecting electronic display device resolution as claimed in claim 1, wherein the line rate, the frame rate, the horizontal total, and the horizontal display are produced by a display card.

9. A machine-readable storage medium storing a computer program providing a method of detecting electronic display device resolution, the method comprising:

receiving a line rate, a frame rate, and a horizontal total of an electronic display device to calculate at least one candidate resolution;

receiving a horizontal display of the electronic display device;

calculating a horizontal blank according to the line rate and the horizontal display;

determining an adjustment method for application to the electronic display device according to the horizontal blank; and selecting a optimum resolution from the candidate resolutions according to the determined adjustment method, wherein the adjustment method for application to the electronic display device further calculates a simulated resolution.

10. The machine-readable storage medium as claimed in claim 9, further displaying a frame on the electronic display device according to the optimum resolution.

11. The machine-readable storage medium as claimed in claim 9, wherein the horizontal blank is the difference between the line rate and the horizontal display.

12. The machine-readable storage medium as claimed in claim 9, wherein the adjustment method for application to the electronic display device is accomplished by increasing the horizontal display.

13. The machine-readable storage medium as claimed in claim 9, wherein the adjustment method for application to the electronic display device is accomplished by decreasing the horizontal total.

14. The machine-readable storage medium as claimed in claim 9, wherein the simulated resolution is the ratio of the horizontal total to the horizontal display.

15. The machine-readable storage medium as claimed in claim 9, wherein the optimum resolution is selected from the candidate resolutions according to the simulated resolution.

16. The machine-readable storage medium as claimed in claim 9, wherein the line rate, the frame rate, the horizontal total, and the horizontal display are produced by a display card.

17. An electronic display device, comprising:

a processing unit, receiving a line rate, a frame rate, and a horizontal total of the electronic display device to calculate at least one candidate resolution, receiving a horizontal display of the electronic display device, calculating a horizontal blank according to the line rate and the horizontal display, determining an adjustment method for application to the electronic display device according to the horizontal blank, and selecting an optimum resolution from the candidate resolutions according to the determined adjustment method, wherein the adjustment method for application to the electronic display device further calculates a simulated resolution; and a display screen, displaying a frame according to the optimum resolution.

18. The electronic display device as claimed in claim 17, wherein the horizontal blank is the difference between the line rate and the horizontal display.

19. The electronic display device as claimed in claim 17, wherein the adjustment method for application to the electronic display device is accomplished by increasing the horizontal display.

20. The electronic display device as claimed in claim 17, wherein the adjustment method for application to the electronic display device is accomplished by decreasing the horizontal total.

21. The electronic display device as claimed in claim 17, wherein the simulated resolution is the ratio of the horizontal total to the horizontal display.

22. The electronic display device as claimed in claim 17, wherein the optimum resolution is selected from the candidate resolutions according to the simulated resolution.

23. The electronic display device as claimed in claim 17, wherein the line rate, the frame rate, the horizontal total, and the horizontal display are produced by a display card.

24. The electronic display device as claimed in claim 17, wherein the processing unit is implemented in a chip.

* * * * *